US009915267B2

(12) United States Patent
Schrand

(10) Patent No.: US 9,915,267 B2
(45) Date of Patent: Mar. 13, 2018

(54) FAN INLET RECIRCULATION GUIDE VANES

(71) Applicant: Air Distribution Technologies IP, LLC, Milwaukee, WI (US)

(72) Inventor: Timothy A. Schrand, Dayton, OH (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 108 days.

(21) Appl. No.: 14/733,900

(22) Filed: Jun. 8, 2015

(65) Prior Publication Data

US 2016/0356288 A1 Dec. 8, 2016

(51) Int. Cl.
*F04D 29/28* (2006.01)
*F04D 29/16* (2006.01)
*F04D 29/42* (2006.01)

(52) U.S. Cl.
CPC ..... *F04D 29/162* (2013.01); *F04D 29/282* (2013.01); *F04D 29/4213* (2013.01); *F04D 29/4226* (2013.01); *F05D 2240/126* (2013.01)

(58) Field of Classification Search
None
See application file for complete search history.

(56) References Cited

U.S. PATENT DOCUMENTS 3,781,127 A 12/1973 Wood
4,299,535 A * 11/1981 Brockman ..... F04D 29/462 415/160
8,276,362 B2 10/2012 Suciu et al.
8,333,559 B2 12/2012 Bushnell
8,475,111 B2 * 7/2013 Stagg ..... F04D 17/06 415/1
2009/0263238 A1 10/2009 Jarrah
2011/0217162 A1 * 9/2011 Dillon ..... F04D 29/4206 415/207
2011/0217164 A1 * 9/2011 Cote ..... F04D 29/547 415/223
2012/0047830 A1 * 3/2012 Phuly ..... E02D 27/42 52/294
2012/0195752 A1 * 8/2012 Lopez Partida ..... F01D 25/24 415/213.1
2012/0210572 A1 * 8/2012 Kampf ..... F04D 25/08 29/700
2012/0230816 A1 * 9/2012 Boufflert ..... F04D 29/42 415/203
2013/0019585 A1 1/2013 Merry et al.

OTHER PUBLICATIONS

The Office Action issued by the Canadian Intellectual Property Office dated Apr. 26, 2017 for the corresponding Canadia patent application No. 2,931,969.

* cited by examiner

*Primary Examiner* — Dwayne J White
*Assistant Examiner* — Theodore Ribadeneyra
(74) *Attorney, Agent, or Firm* — Fletcher Yoder, P.C.

(57) ABSTRACT

A fan structure comprising a base, a fan inlet funnel coupled to the base, the fan inlet funnel having an inner surface for conducting air flow into a fan inlet and an outer surface and a plurality of external ribs coupled to the outer surface of the fan inlet funnel.

19 Claims, 21 Drawing Sheets

FAN INLET RECIRCULATION GUIDE VANES

TECHNICAL FIELD

The present disclosure relates generally to heating, ventilation and cooling equipment, and more specifically to recirculation guide vanes for a fan inlet funnel that improve the static efficiency of the associated fan.

BACKGROUND OF THE INVENTION

Fan inlet funnels are used to minimize the amount of air that is recirculated between the fan outlet side and the fan inlet side. Fan inlet funnels can be fabricated from any suitable material, but non-metallic materials such as polymers can be used to decrease the cost and weight of the fan inlet funnel.

SUMMARY OF THE INVENTION

A fan structure is disclosed that includes a base and a fan inlet funnel coupled to the base. The fan inlet funnel has an inner surface for conducting air flow into a fan inlet and an outer surface. A plurality of external ribs are coupled to the outer surface of the fan inlet funnel, so as to provide recirculation guidance that increases static efficiency and other performance characteristics of an associated fan or blower.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
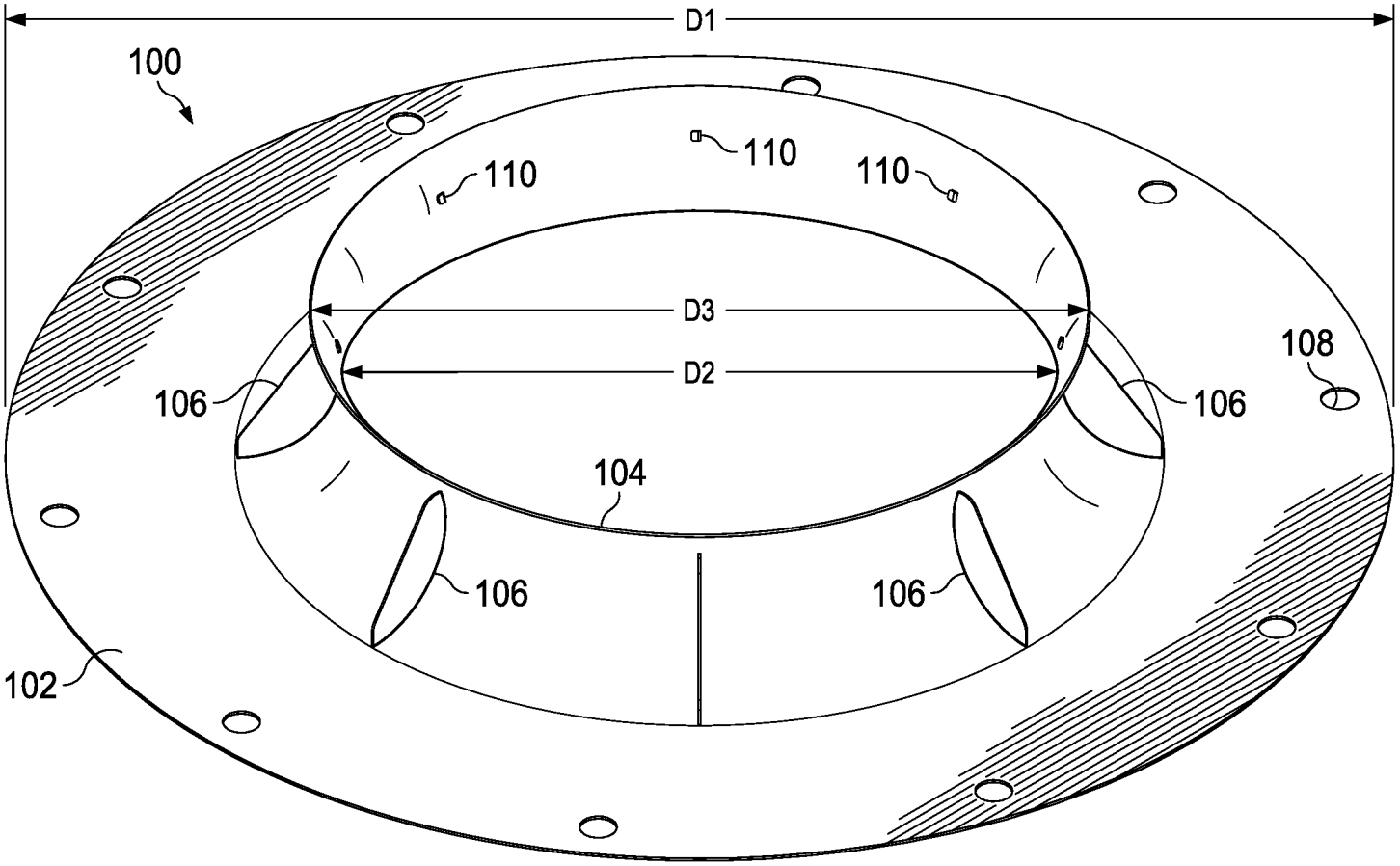
FIG. 1 is an isometric diagram of a fan inlet funnel with a straight external rib design, in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

FIG. 1 is an isometric diagram of a fan inlet funnel 100 with a straight external rib design, in accordance with an exemplary embodiment of the present disclosure. Fan inlet funnel 100 includes circular base 102, circular inlet funnel cone 104 and external ribs 106, which can be formed from one or more pieces of a polymer material, a rubber material, an elastomer material, a metal material, a compound material, or other suitable materials, such as by casting, injection molding, compression molding, extrusion or in other suitable manners. Base 102 is a disc having a circular cutout portion that joins to inlet funnel cone 104. External ribs 106 are disposed around the periphery of inlet funnel cone 104, and can be connected to inlet funnel cone 104 by tab 110 or by other suitable mechanisms or in other suitable manners, where tab 110 extends through the wall of inlet funnel 104. External ribs 106 can be formed from a polymer, a rubber, an elastomer or other suitable materials, and be formed from the same material as base 102 and inlet funnel cone 104 or from different materials. Inlet funnel cone 104 has an outer diameter D3 and an inner diameter D2, and base 102 has an outer diameter D1. Bolt holes 108 are disposed around a circumference of base 102. The inner surface of inlet funnel cone 104 is generally smooth, except for tabs 110, which helps to improve the static efficiency of an associated fan or blower.

In operation, fan inlet funnel 100 is disposed on a fan inlet, where it is secured by bolts (not explicitly shown) that are connected through bolt holes 108. A gasket or other suitable materials can also be used, where suitable, in order to improve the seal between fan inlet funnel 100 and the fan inlet. External ribs 106 further improve the static efficiency of the fan by providing structural support to fan inlet funnel cone 104. The increase in static efficiency is particularly noticeable where fan inlet funnel cone 104 has external ribs 106, as external ribs 106 help to guide air into the fan and prevent turbulent flow, which can decrease static efficiency and other performance characteristics. External ribs 106 are straight and follow the contour of inlet funnel cone 104, and have a maximum height in the center and taper evenly towards the ends. Although eight external ribs 106 are shown separated by 45 degrees of arc, and ten bolt holes 108 are shown separated by 36 degrees of arc, other suitable numbers of external ribs and bolt holes, and degrees of arc separation, can also or alternatively be used, including asymmetrical or non-uniform configurations.

Figure 2:
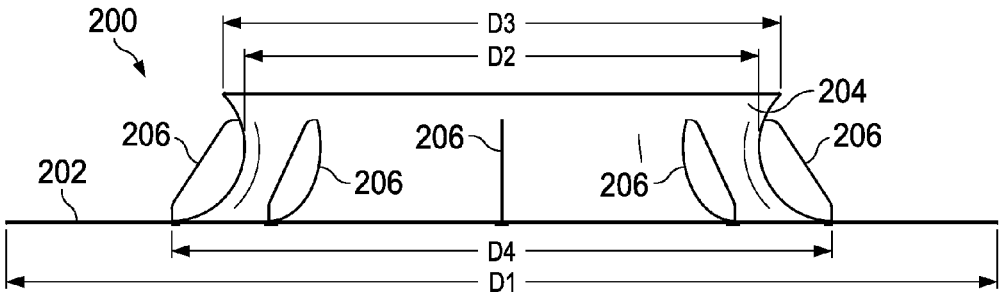
FIG. 2 is a side view of a fan inlet funnel with the straight external rib design, in accordance with an exemplary embodiment of the present disclosure.

FIG. 2 is a side view of a fan inlet funnel 200 with the straight external rib design, in accordance with an exemplary embodiment of the present disclosure. Circular base 202 has an outer diameter D1 and an inner diameter D4, and inlet funnel cone 204 has an inner diameter D2 and an outer top diameter D3, where D1>D4>D3>D2. Other suitable relationships between the diameters can also or alternatively be used, such as where D4=D3.

Figure 3A:
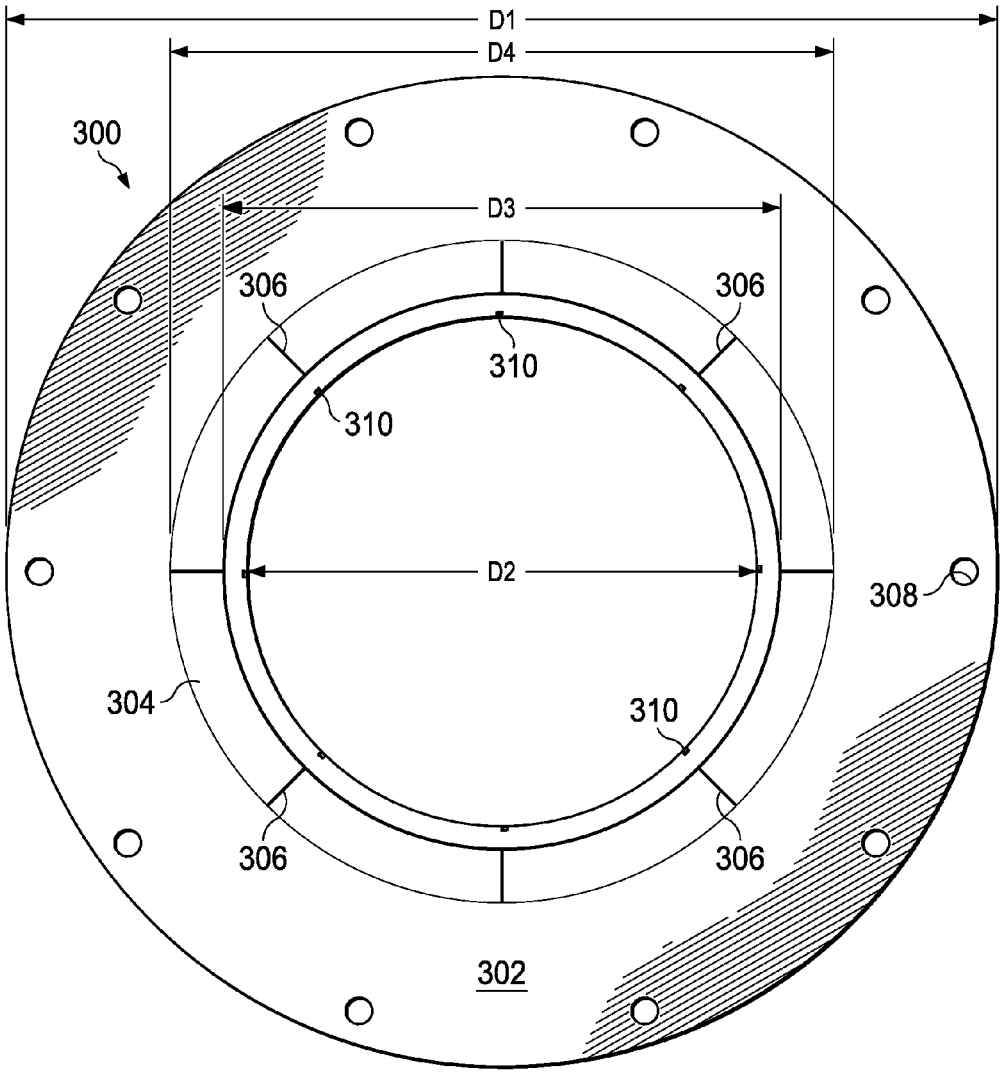
FIG. 3A is an overhead view of a fan inlet funnel with the straight external rib design, in accordance with an exemplary embodiment of the present disclosure.

FIG. 3A is an overhead view of a fan inlet funnel 300 with the straight external rib design, in accordance with an exemplary embodiment of the present disclosure. Base 302 has an outer diameter D1 and an inner diameter D4, and is coupled to inlet funnel cone 304 having an inner diameter D2 and an outer top diameter D3, and which is supported by external ribs 306. External ribs 306 are coupled to inlet funnel cone 304 by tabs 310, but adhesives, epoxies, welds, bolts or other suitable materials, configurations or connections can also or alternatively be used. Bolt holes 308 are used to connect base 302 to a fan inlet (not shown).

Figure 3B:
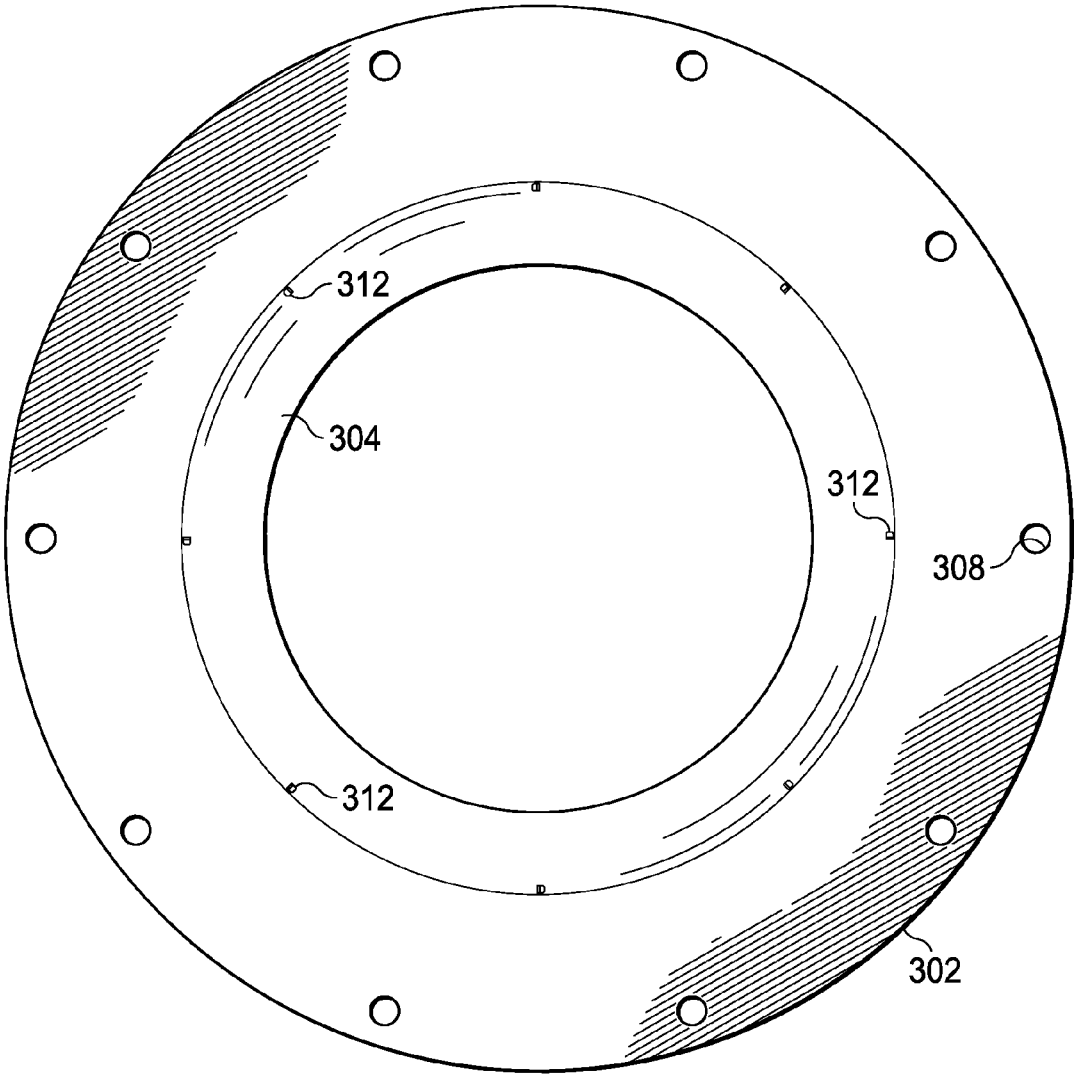
FIG. 3B is a bottom view of a fan inlet funnel with the straight external rib design, in accordance with an exemplary embodiment of the present disclosure.

FIG. 3B is a bottom view of a fan inlet funnel 300 with the straight external rib design, in accordance with an exemplary embodiment of the present disclosure. Tabs 312 of external ribs 306 are coupled to the junction of base 302 and inlet funnel cone 304, such as by forming a hole or incision in the material of base 302 and inlet funnel cone 304 and extending tab 312 of external ribs 306 through the hole. Tab 312 can be secured by glue, epoxy, a mechanical device or in other suitable manners.

Figure 4:
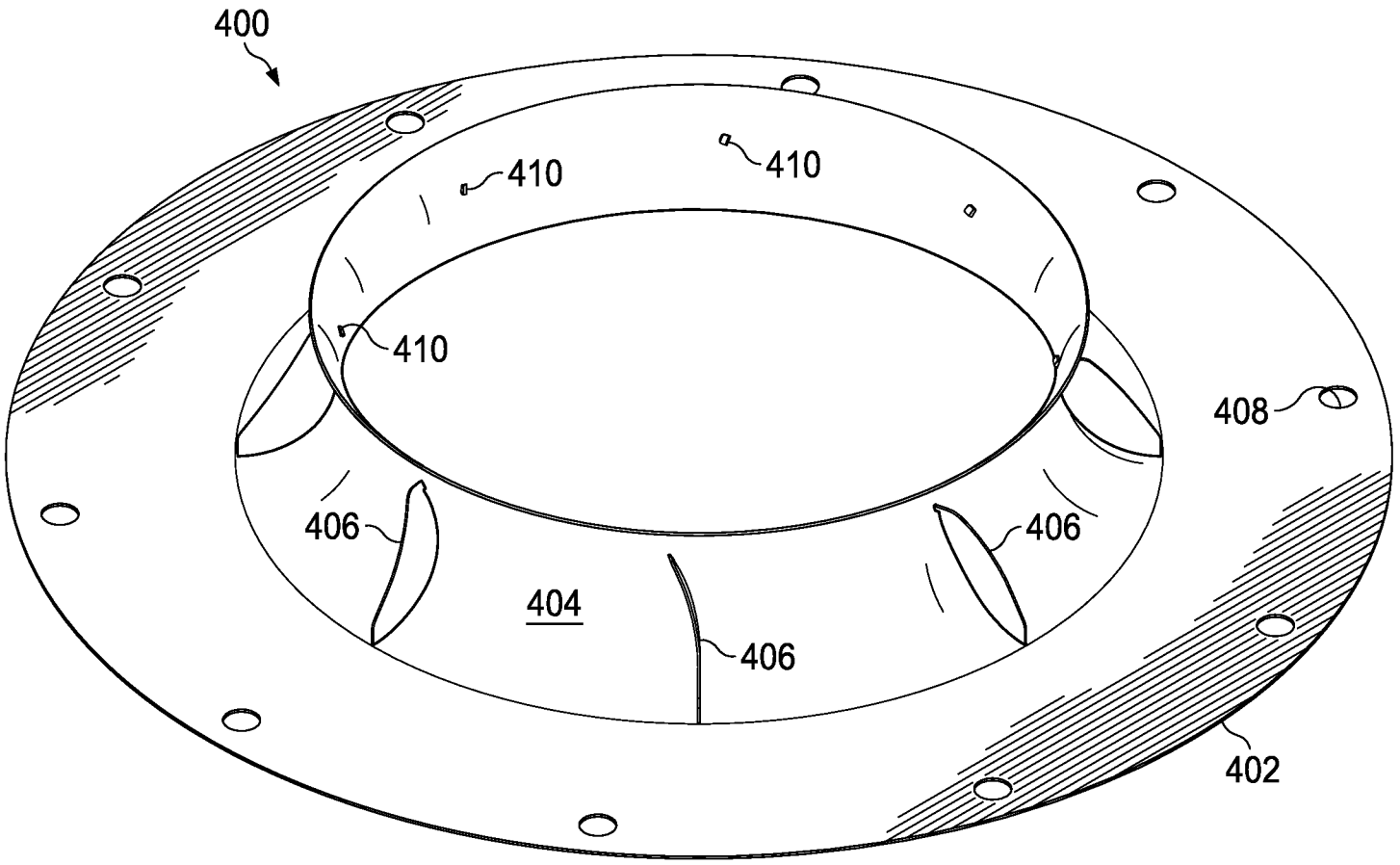
FIG. 4 is an isometric diagram of a fan inlet funnel with a left curve external rib design, in accordance with an exemplary embodiment of the present disclosure.

FIG. 4 is an isometric diagram of a fan inlet funnel 400 with a left curve external rib design, in accordance with an exemplary embodiment of the present disclosure. Inlet funnel cone 404 is coupled to base 402 and is supported by left curve external ribs 406, which are secured to inlet funnel cone 404 by tab 410 and/or other suitable structures. External ribs 406 follow the curvature of inlet funnel cone 404, but curve left above the base of inlet funnel cone 404.

Figure 5:
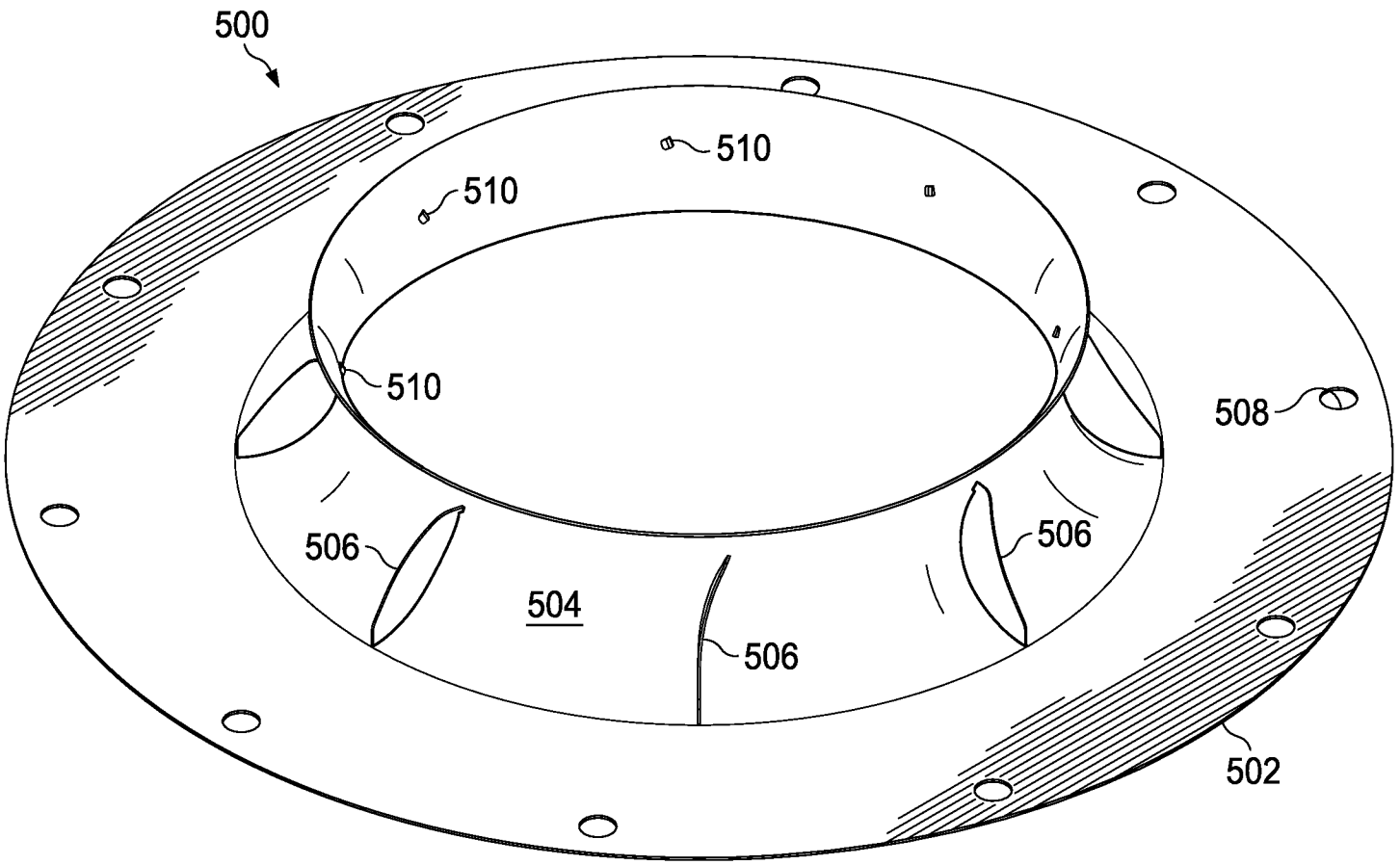
FIG. 5 is an isometric diagram of a fan inlet funnel with a right curve external rib design, in accordance with an exemplary embodiment of the present disclosure.

FIG. 5 is an isometric diagram of a fan inlet funnel 500 with a right curve external rib design, in accordance with an exemplary embodiment of the present disclosure. Inlet funnel cone 504 is coupled to base 502 and is supported by right curve external ribs 506, which are secured to inlet funnel cone 504 by tab 510 and/or other suitable structures. External ribs 506 follow the curvature of inlet funnel cone 404, but curve right above the base of inlet funnel cone 504.

Figure 6:
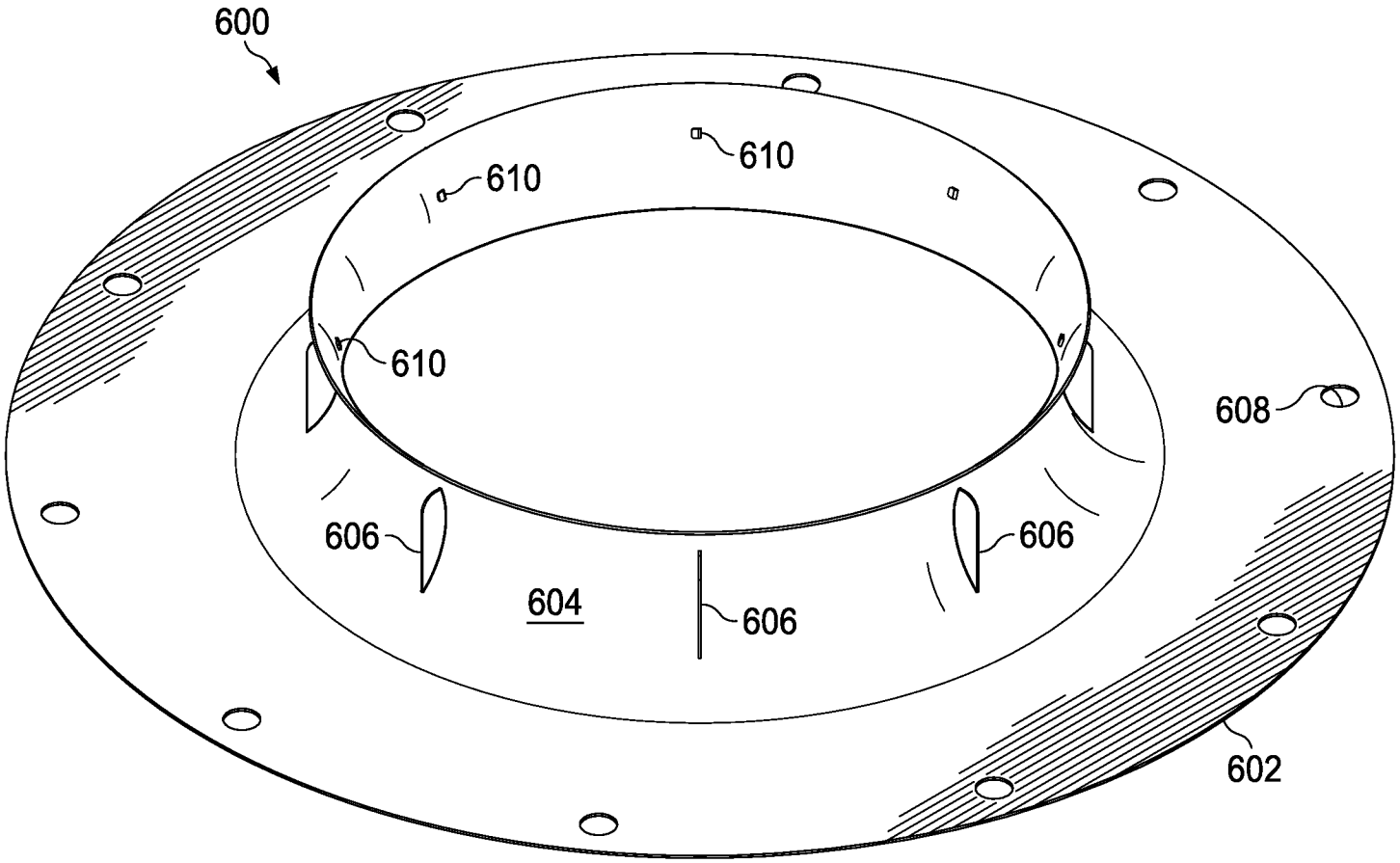
FIG. 6 is an isometric diagram of a fan inlet funnel with a short external mid-rib design, in accordance with an exemplary embodiment of the present disclosure.

FIG. 6 is an isometric diagram of a fan inlet funnel 600 with a short external mid-rib design, in accordance with an exemplary embodiment of the present disclosure. Inlet funnel cone 604 is coupled to base 602 and is supported by short external mid-ribs 606, which are secured to inlet funnel cone 604 by tab 610 and/or other suitable structures. External mid-ribs 606 follow the curvature of inlet funnel cone 604, but only for a portion of the height of inlet funnel cone 604 and above the point at which base 602 meets inlet funnel cone 604.

Figure 7:
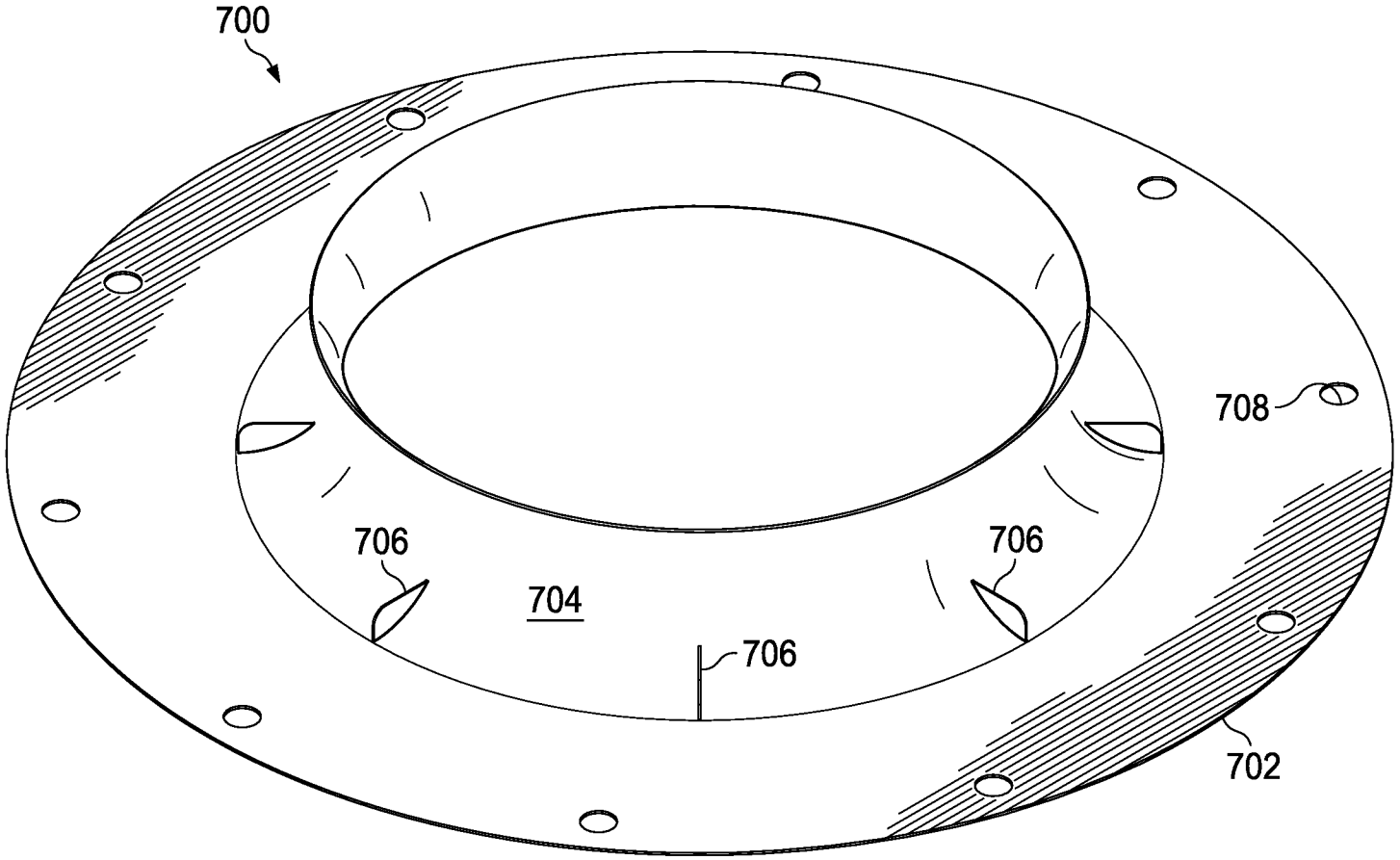
FIG. 7 is an isometric diagram of a fan inlet funnel with a short external low-rib design, in accordance with an exemplary embodiment of the present disclosure.

FIG. 7 is an isometric diagram of a fan inlet funnel 700 with a short low external rib design, in accordance with an exemplary embodiment of the present disclosure. Inlet funnel cone 704 is coupled to base 702 and is supported by short low external ribs 706, which are secured to inlet funnel cone 704 by tabs and/or other suitable structures. External ribs 706 follow the curvature of inlet funnel cone 704, but only for a portion of the base of inlet funnel cone 704, where it meets base 702.

Figure 8:
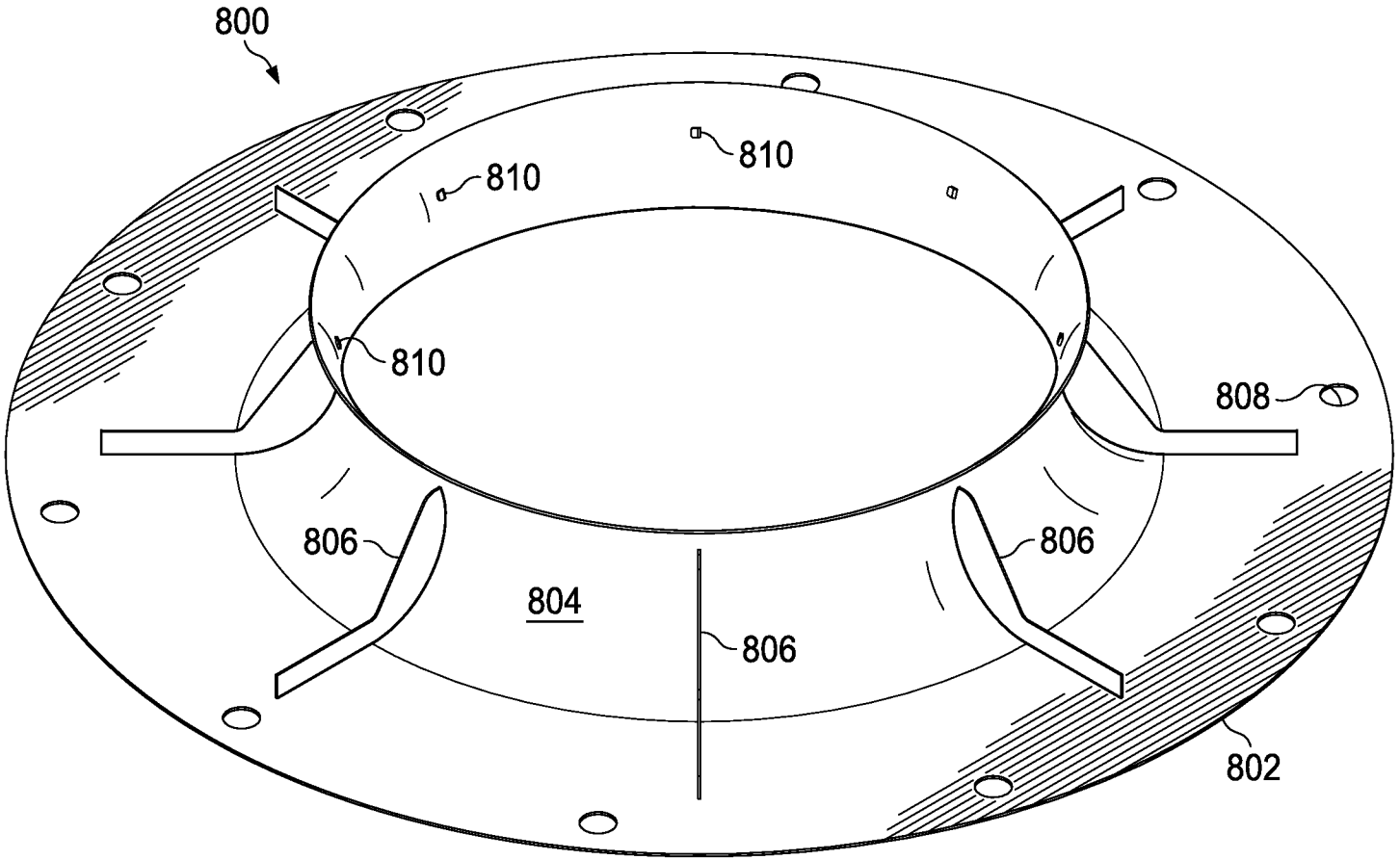
FIG. 8 is an isometric diagram of a fan inlet funnel with an extended straight external rib design, in accordance with an exemplary embodiment of the present disclosure.

FIG. 8 is an isometric diagram of a fan inlet funnel 800 with an extended straight external rib design, in accordance with an exemplary embodiment of the present disclosure. Inlet funnel cone 804 is coupled to base 802 and is supported by extended straight external ribs 806, which are secured to inlet funnel cone 804 by tabs 810 and/or other suitable structures. External ribs 806 follow the curvature of inlet funnel cone 804 and then extend outward onto base 802.

Figure 9:
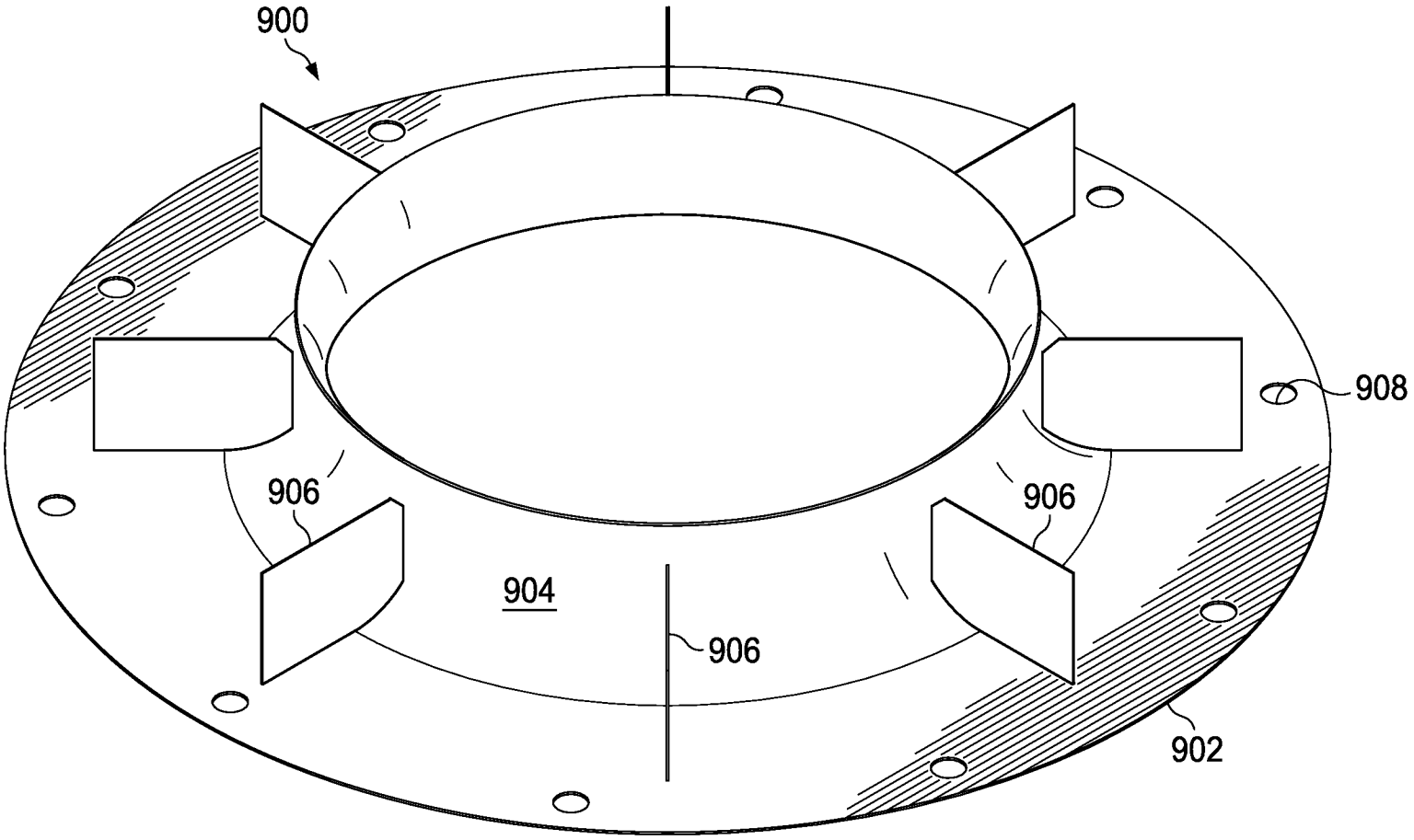
FIG. 9 is an isometric diagram of a fan inlet funnel with a rectangular external rib design, in accordance with an exemplary embodiment of the present disclosure.

FIG. 9 is an isometric diagram of a fan inlet funnel 900 with a rectangular external rib design, in accordance with an exemplary embodiment of the present disclosure. Inlet funnel cone 904 is coupled to base 902 and is supported by rectangular external ribs 906, which are secured to inlet funnel cone 904 by tabs and/or other suitable structures. External ribs 906 are rectangular, and follow the curvature of inlet funnel cone 904, but only for a portion of the base of inlet funnel cone 906.

Figure 10:
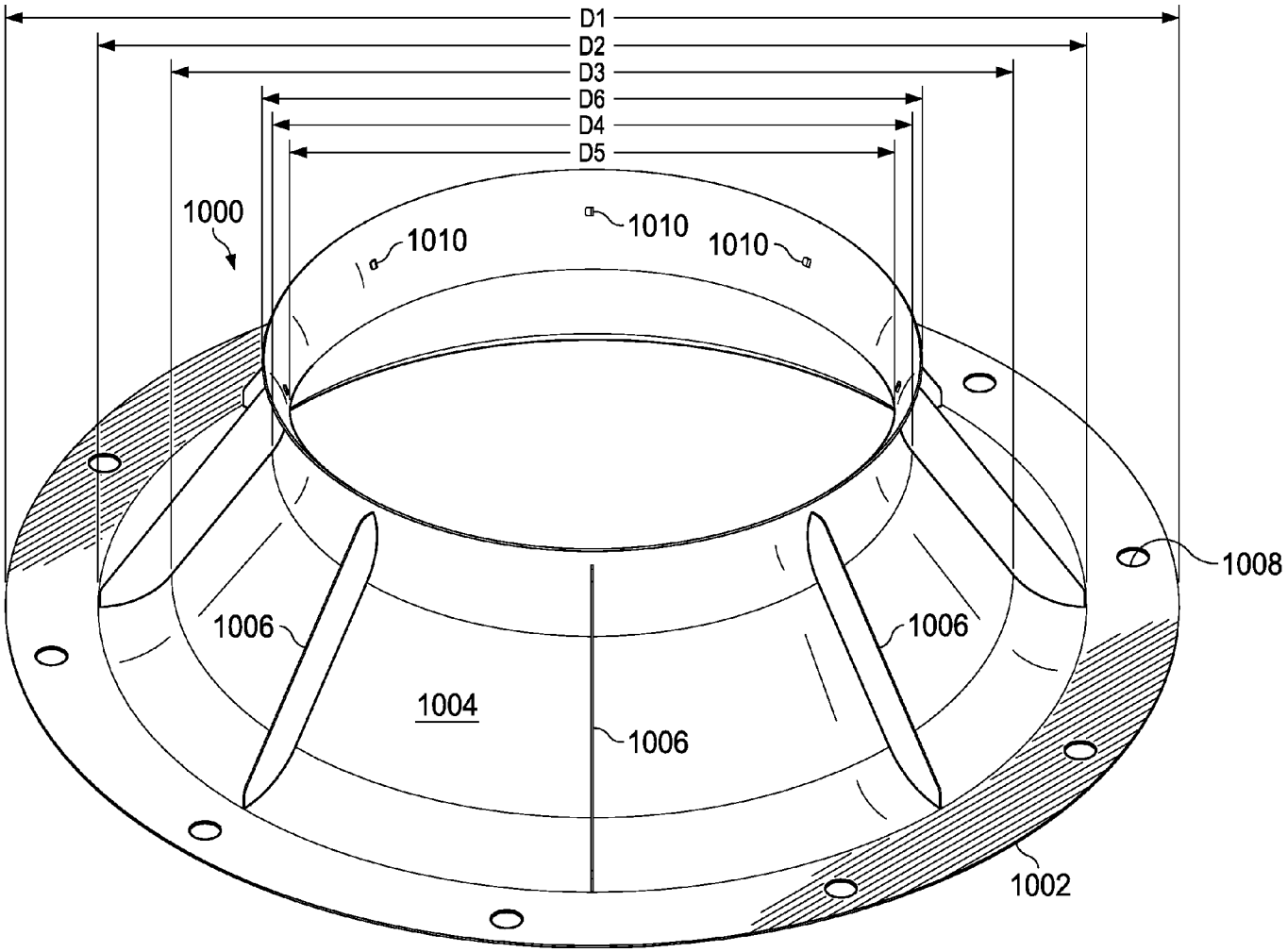
FIG. 10 is an isometric diagram of an extended fan inlet funnel with a straight external rib design, in accordance with an exemplary embodiment of the present disclosure.

FIG. 10 is an isometric diagram of an extended fan inlet funnel 1000 with a straight external rib design, in accordance with an exemplary embodiment of the present disclosure. Extended inlet funnel cone 1004 has a base with diameter D2 that meets with the inner diameter of base 1002. Extended inlet funnel cone 1004 then curves upwards to a flat portion between diameters D3 and D4. The extended inlet funnel cone 1004 then curves inwards to a minimum diameter D5 and then outwards to an upper diameter D6, where D5<D4<D6<D3<D2<D1. External ribs 1006 are secured to extended inlet funnel cone 1004 by tab 1010 and/or other suitable structures. External ribs 1006 follow the curvature of extended inlet funnel cone 1004, including the straight portion.

Figure 11:
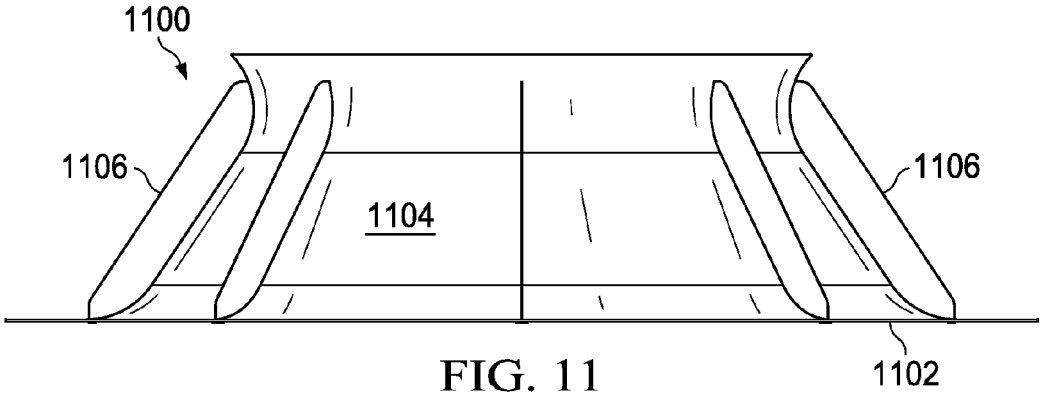
FIG. 11 is a side view of an extended fan inlet funnel with a straight external rib design, in accordance with an exemplary embodiment of the present disclosure.

FIG. 11 is a side view of an extended fan inlet funnel 1100 with a straight external rib design, in accordance with an exemplary embodiment of the present disclosure. Extended inlet funnel cone 1104 is coupled to base 1102 and is supported by straight external ribs 1106, which are secured to extended inlet funnel cone 1104 by tabs and/or other suitable structures. External ribs 1106 follow the curvature of extended inlet funnel cone 1104, including the straight portion.

Figure 12A:
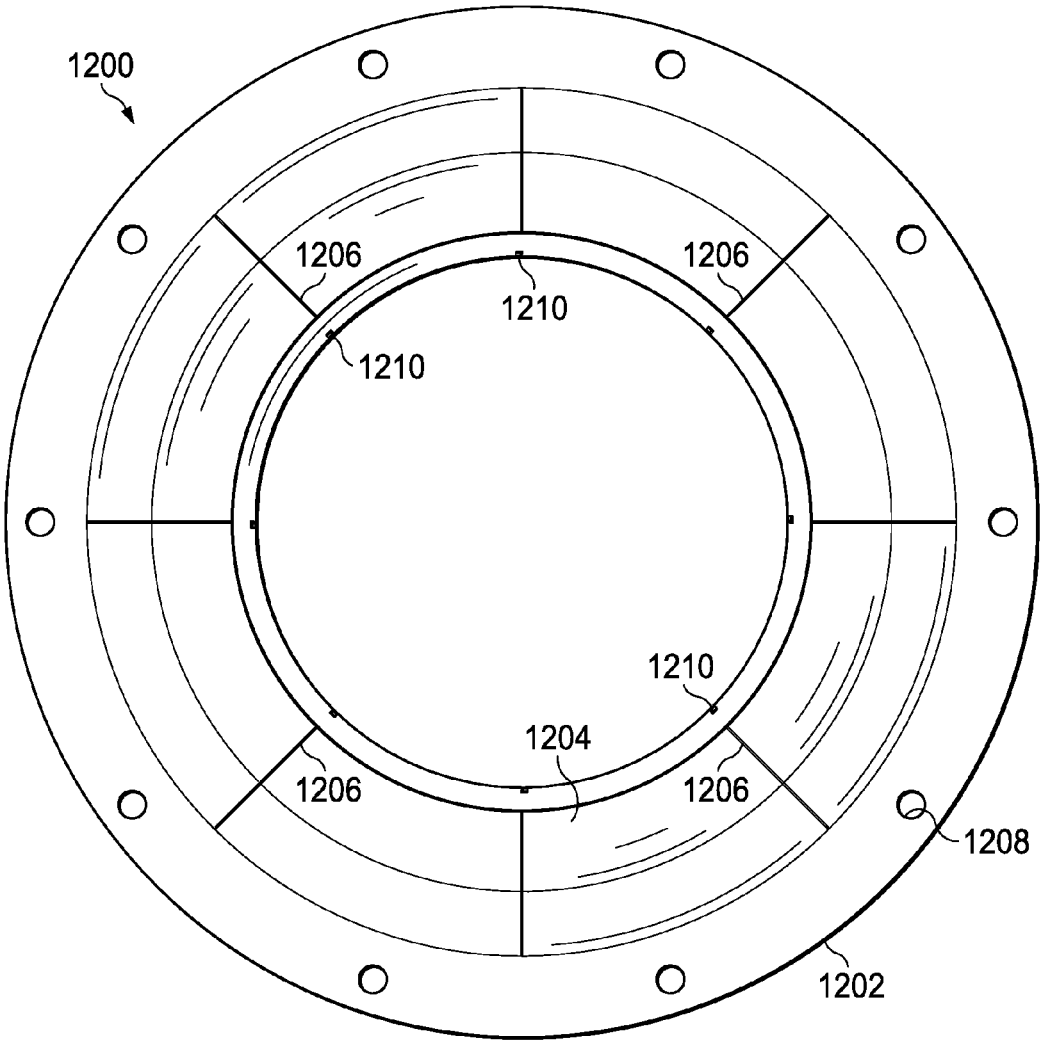
FIG. 12A is a top view of an extended fan inlet funnel with a straight external rib design, in accordance with an exemplary embodiment of the present disclosure.

FIG. 12A is a top view of an extended fan inlet funnel 1200 with a straight external rib design, in accordance with an exemplary embodiment of the present disclosure. External ribs 1206 are coupled o extended inlet funnel cone 1204 by tabs 1210.

Figure 12B:
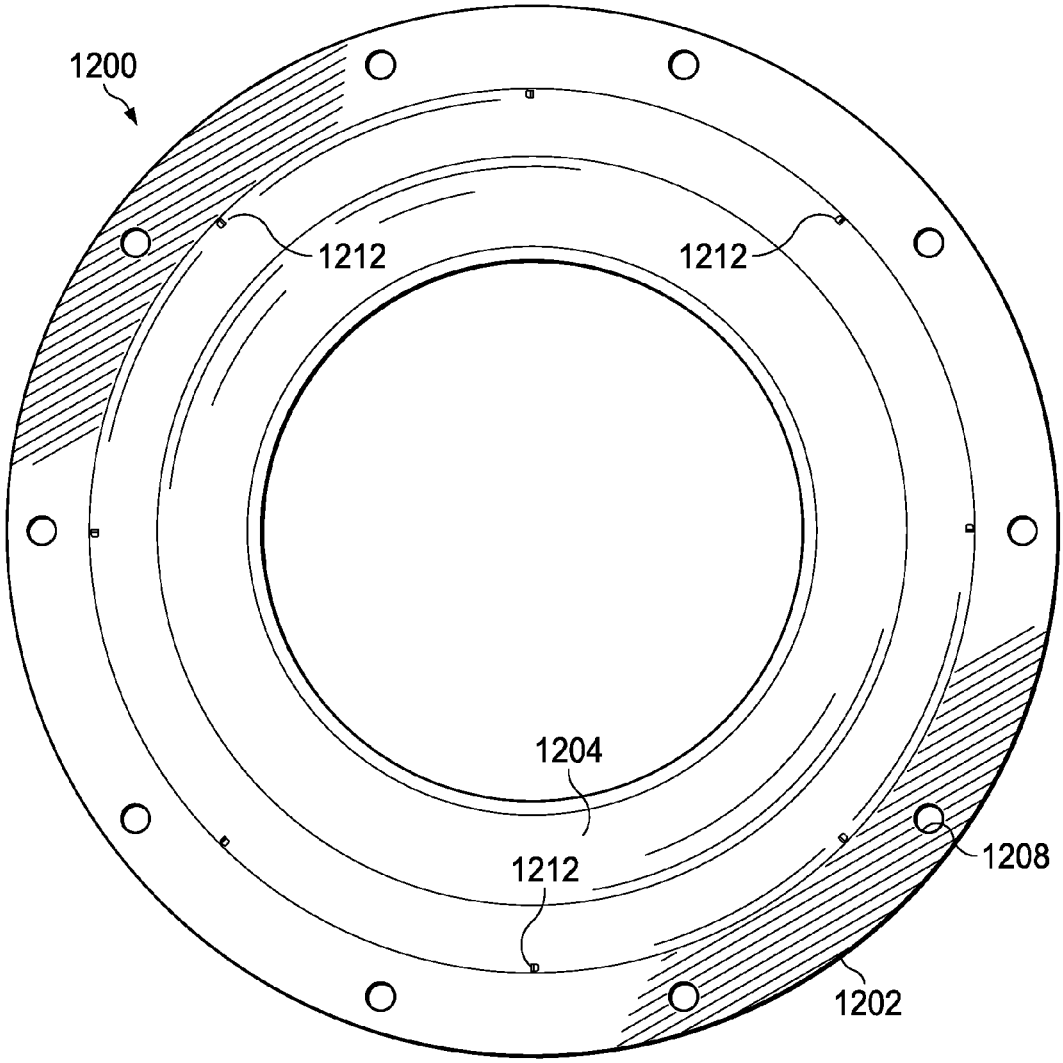
FIG. 12B is a bottom view of an extended fan inlet funnel with a straight external rib design, in accordance with an exemplary embodiment of the present disclosure.

FIG. 12B is a bottom view of an extended fan inlet funnel 1200 with a straight external rib design, in accordance with an exemplary embodiment of the present disclosure. External ribs 1206 are coupled to the point between base 1202 and extended inlet funnel cone 1204 by tabs 1212. Likewise, other suitable mechanisms can be used to secure external ribs 1206 to base 1202 and extended inlet funnel cone 1204.

Figure 13:
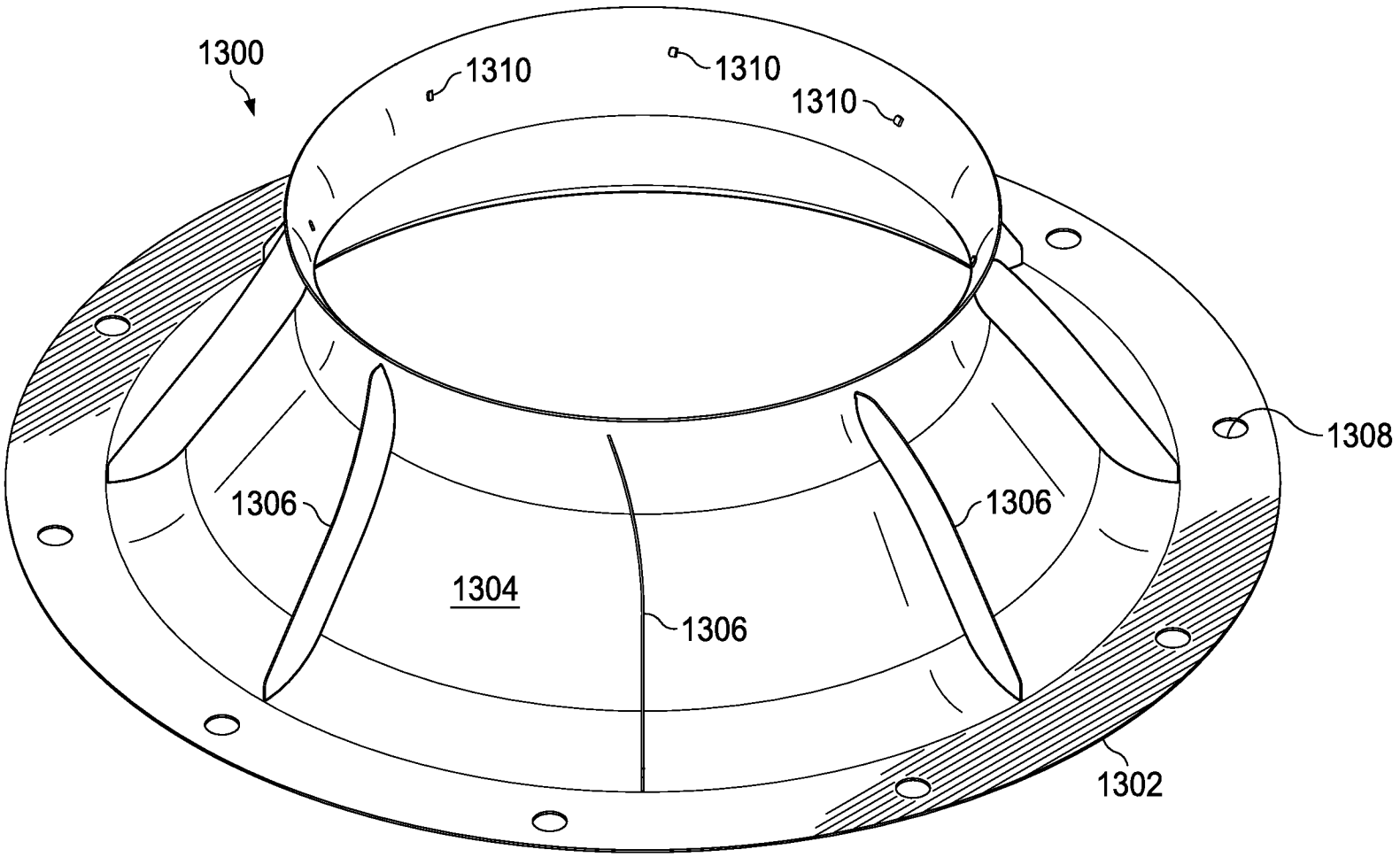
FIG. 13 is an isometric diagram of an extended fan inlet funnel with a left curve external rib design, in accordance with an exemplary embodiment of the present disclosure.

FIG. 13 is an isometric diagram of an extended fan inlet funnel 1300 with a left curve external rib design, in accordance with an exemplary embodiment of the present disclosure. Extended inlet funnel cone 1304 is coupled to base 1302 and is supported by left curve external ribs 1306, which are secured to extended inlet funnel cone 1304 by tabs 1310 and/or other suitable structures or mechanisms. Left curve external ribs 1306 follow the curvature of extended inlet funnel cone 1304, including the straight portion, and also curve towards the left in a radial direction, so as to provide additional structural support for counterclockwise radial forces, such as from air flow generated by the rotation of an associated fan or blower.

Figure 14:
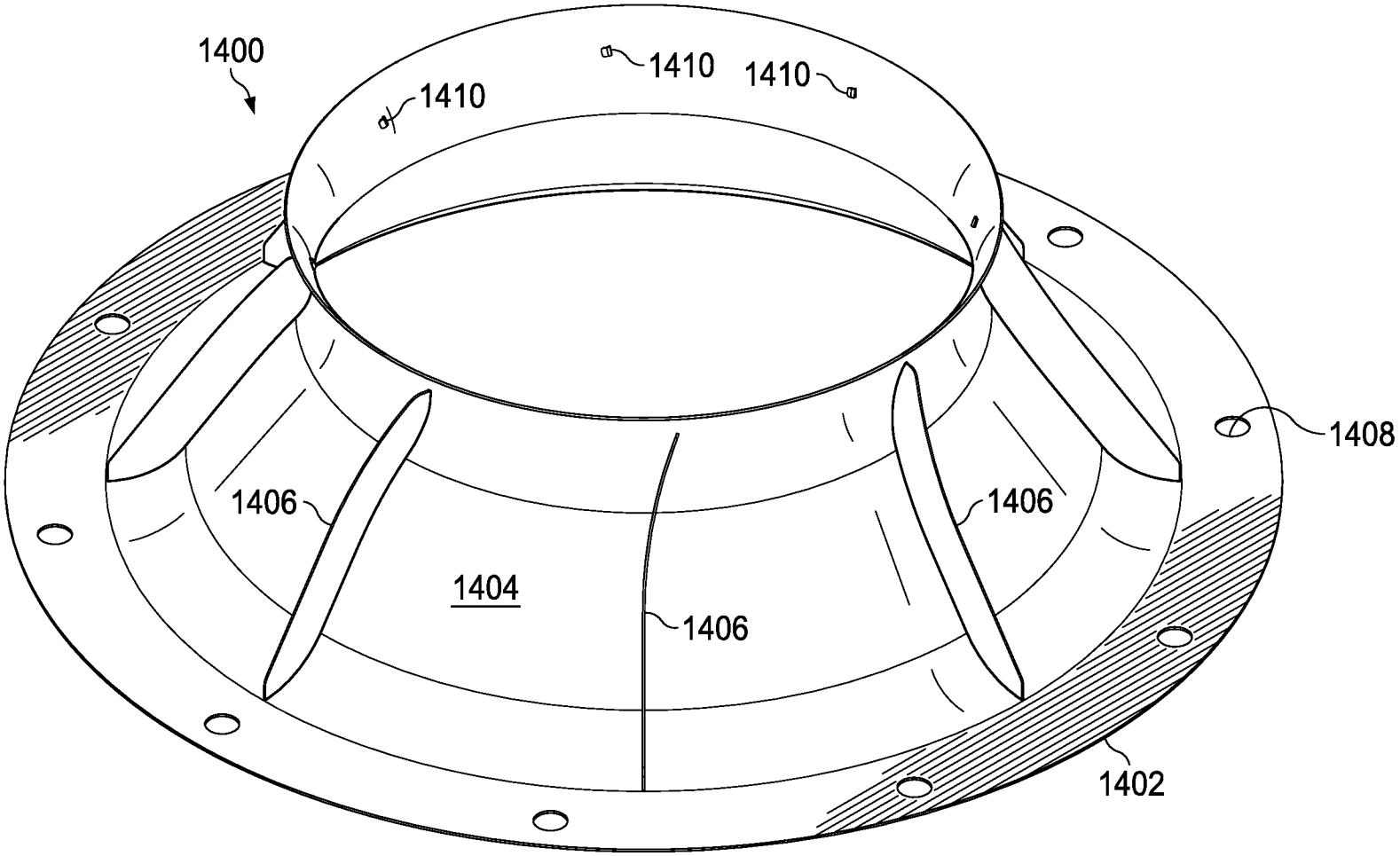
FIG. 14 is an isometric diagram of an extended fan inlet funnel with a right curve external rib design, in accordance with an exemplary embodiment of the present disclosure.

FIG. 14 is an isometric diagram of an extended fan inlet funnel 1400 with a right curve external rib design, in accordance with an exemplary embodiment of the present disclosure. Extended inlet funnel cone 1404 is coupled to base 1402 and is supported by right curve external ribs 1406, which are secured to extended inlet funnel cone 1404 by tabs 1410 and/or other suitable structures or mechanisms. Right curve external ribs 1406 follow the curvature of extended inlet funnel cone 1404, including the straight portion, and also curve towards the right in a radial direction, so as to provide additional air flow guidance, such as for inlet air flow generated by the rotation of an associated fan or blower.

Figure 15:
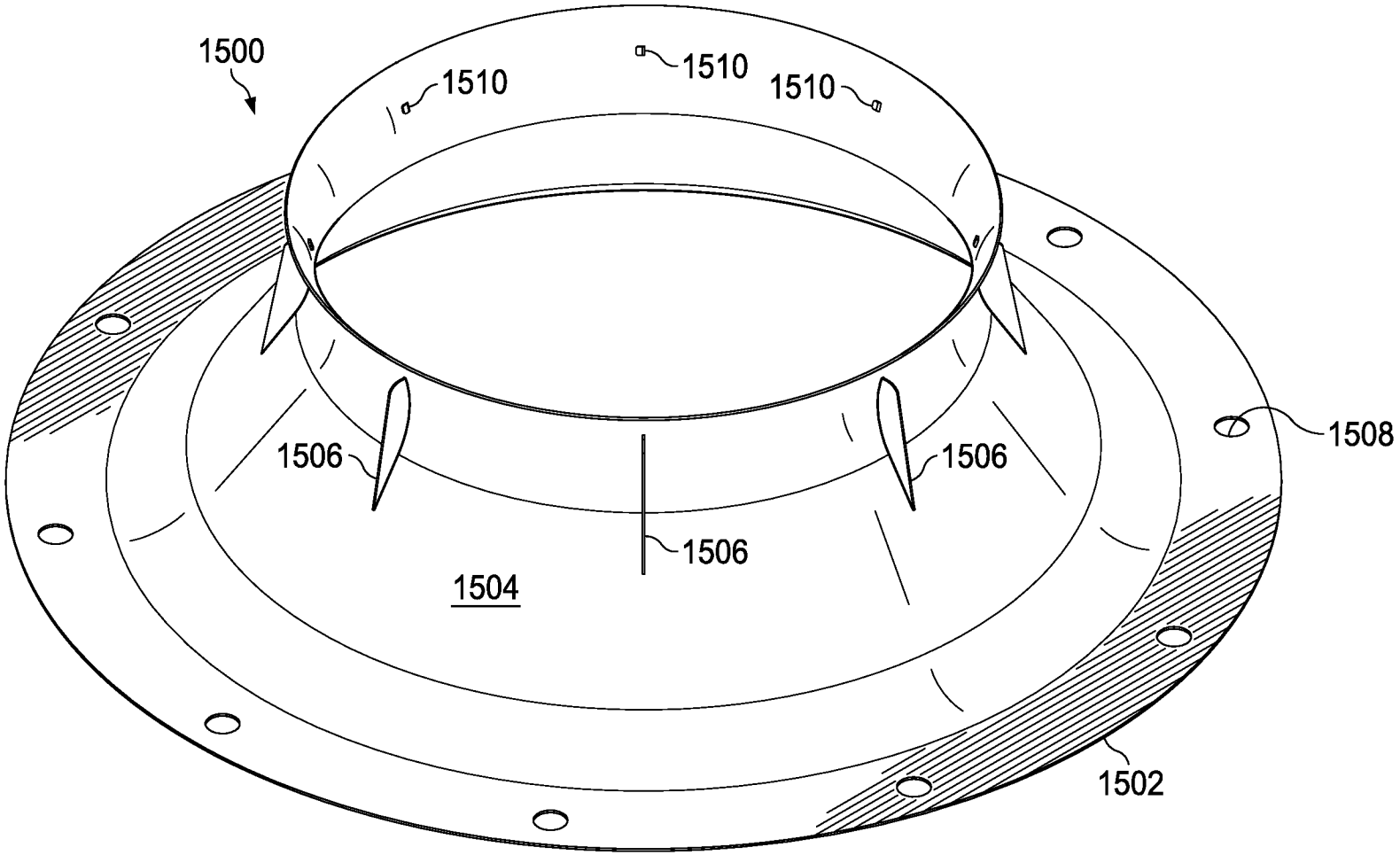
FIG. 15 is an isometric diagram of an extended fan inlet funnel with an upper short external rib design, in accordance with an exemplary embodiment of the present disclosure.

FIG. 15 is an isometric diagram of an extended fan inlet funnel 1500 with an upper short external rib design, in accordance with an exemplary embodiment of the present disclosure. Extended inlet funnel cone 1504 is coupled to base 1502 and is supported by upper short external ribs 1506, which are secured to extended inlet funnel cone 1504 by tabs 1510 and/or other suitable structures or mechanisms. Upper short external ribs 1506 follow the curvature of the upper portion of extended inlet funnel cone 1504, starting at a point on the straight portion and extending towards the top of extended inlet funnel cone 1504, so as to provide additional inlet air flow guidance.

Figure 16:
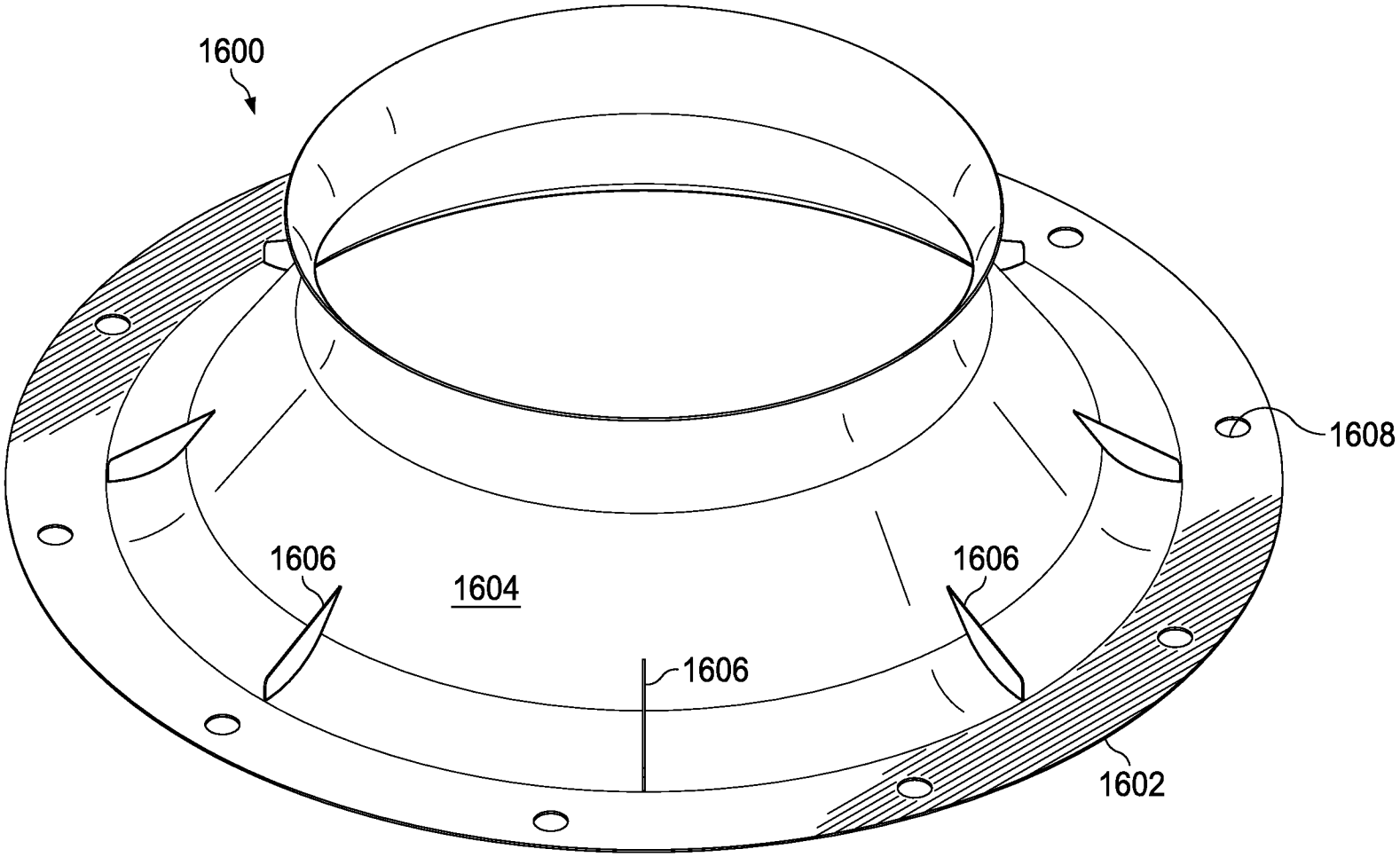
FIG. 16 is an isometric diagram of an extended fan inlet funnel with a lower short external rib design, in accordance with an exemplary embodiment of the present disclosure.

FIG. 16 is an isometric diagram of an extended fan inlet funnel 1600 with a lower short external rib design, in accordance with an exemplary embodiment of the present disclosure. Extended inlet funnel cone 1604 is coupled to base 1602 and is supported by lower short external ribs 1606, which are secured to extended inlet funnel cone 1604 by tabs and/or other suitable structures or mechanisms. Lower short external ribs 1606 follow the curvature of the lower portion of extended inlet funnel cone 1604, starting at a point on base 1602 and extending onto the lower end of the straight portion of extended inlet funnel cone 1604, so as to provide additional inlet air flow guidance.

Figure 17:
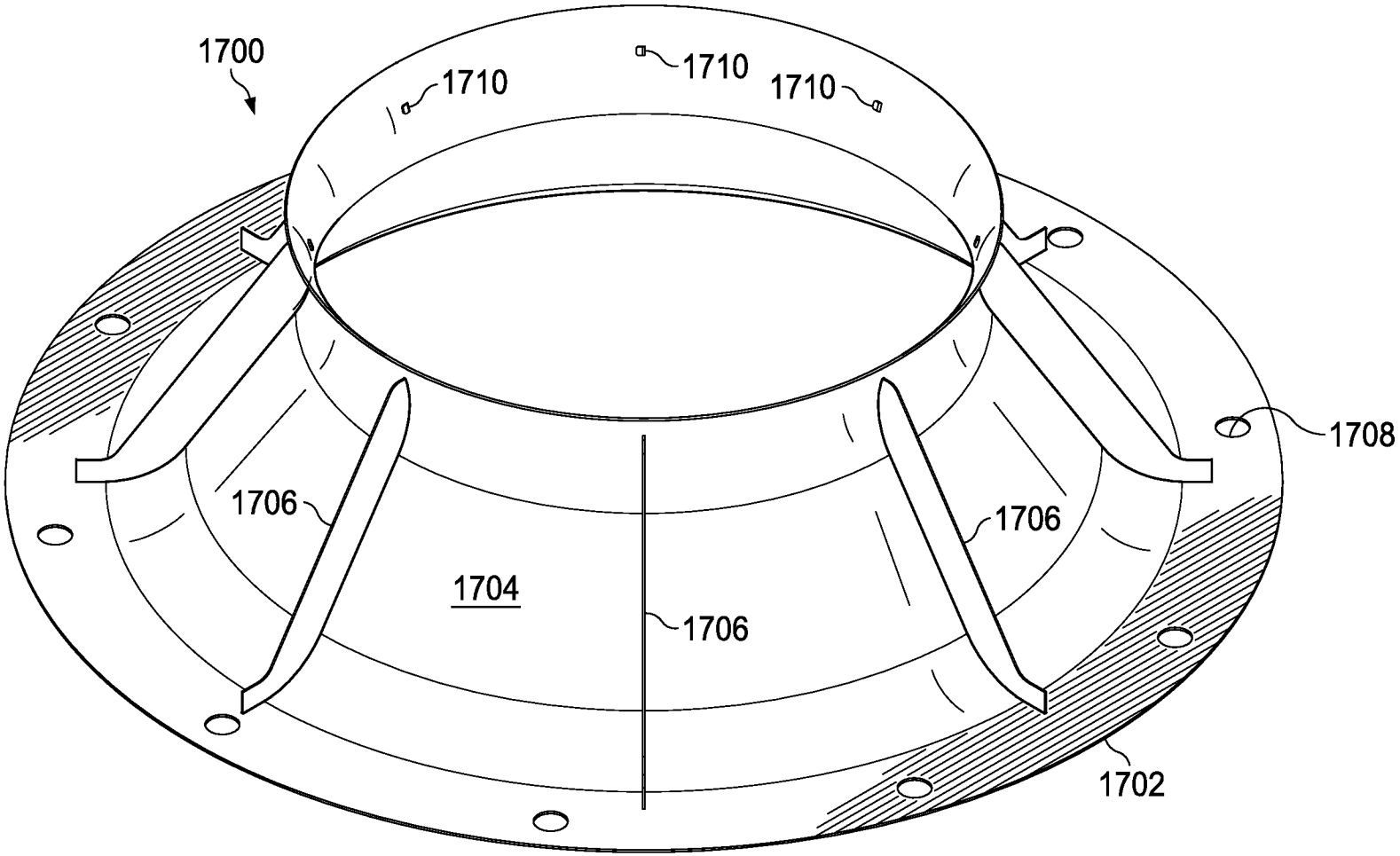
FIG. 17 is an isometric diagram of an extended fan inlet funnel with an extended straight external rib design, in accordance with an exemplary embodiment of the present disclosure.

FIG. 17 is an isometric diagram of an extended fan inlet funnel 1700 with an extended straight external rib design, in accordance with an exemplary embodiment of the present disclosure. Extended inlet funnel cone 1704 is coupled to base 1702 and is supported by extended straight external ribs 1706, which are secured to extended inlet funnel cone 1704 by tabs 1710 and/or other suitable structures or mechanisms. Extended straight external ribs 1706 follow the curvature of the lower portion of extended inlet funnel cone 1704, starting at a point on base 1702 and extending onto the upper curved portion of extended inlet funnel cone 1704, so as to provide inlet air flow guidance.

Figure 18:
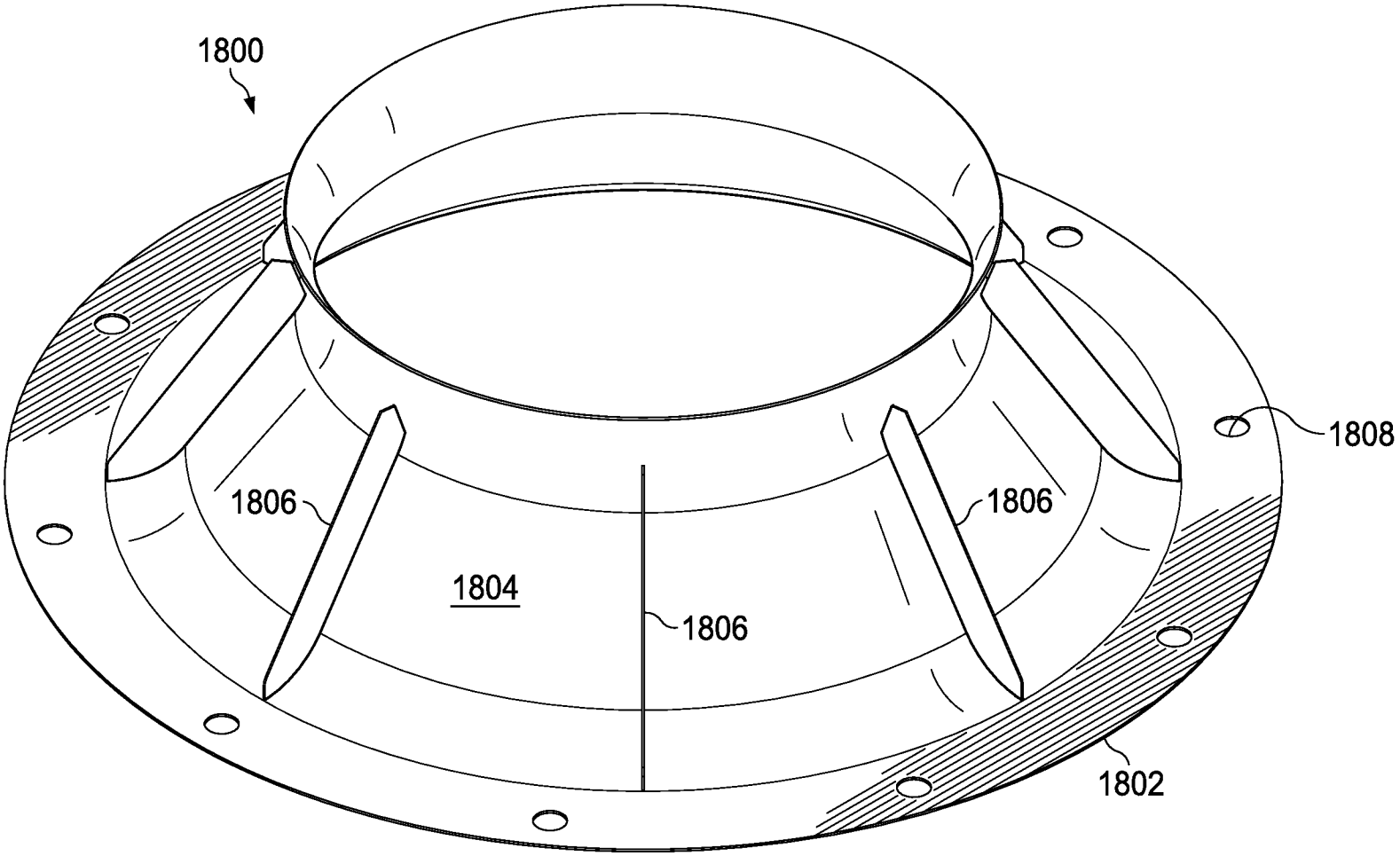
FIG. 18 is an isometric diagram of an extended fan inlet funnel with a straight external rib design, in accordance with an exemplary embodiment of the present disclosure.

FIG. 18 is an isometric diagram of an extended fan inlet funnel 1800 with a straight external rib design, in accordance with an exemplary embodiment of the present disclosure. Extended inlet funnel cone 1804 is coupled to base 1802 and is supported by lower external ribs 1806, which are secured to extended inlet funnel cone 1804 by tabs and/or other suitable structures or mechanisms. External ribs 1806 follow the curvature of the lower and upper portions of extended inlet funnel cone 1804 and extend along the straight portion of extended inlet funnel cone 1804, so as to provide inlet air flow guidance.

Figure 19:
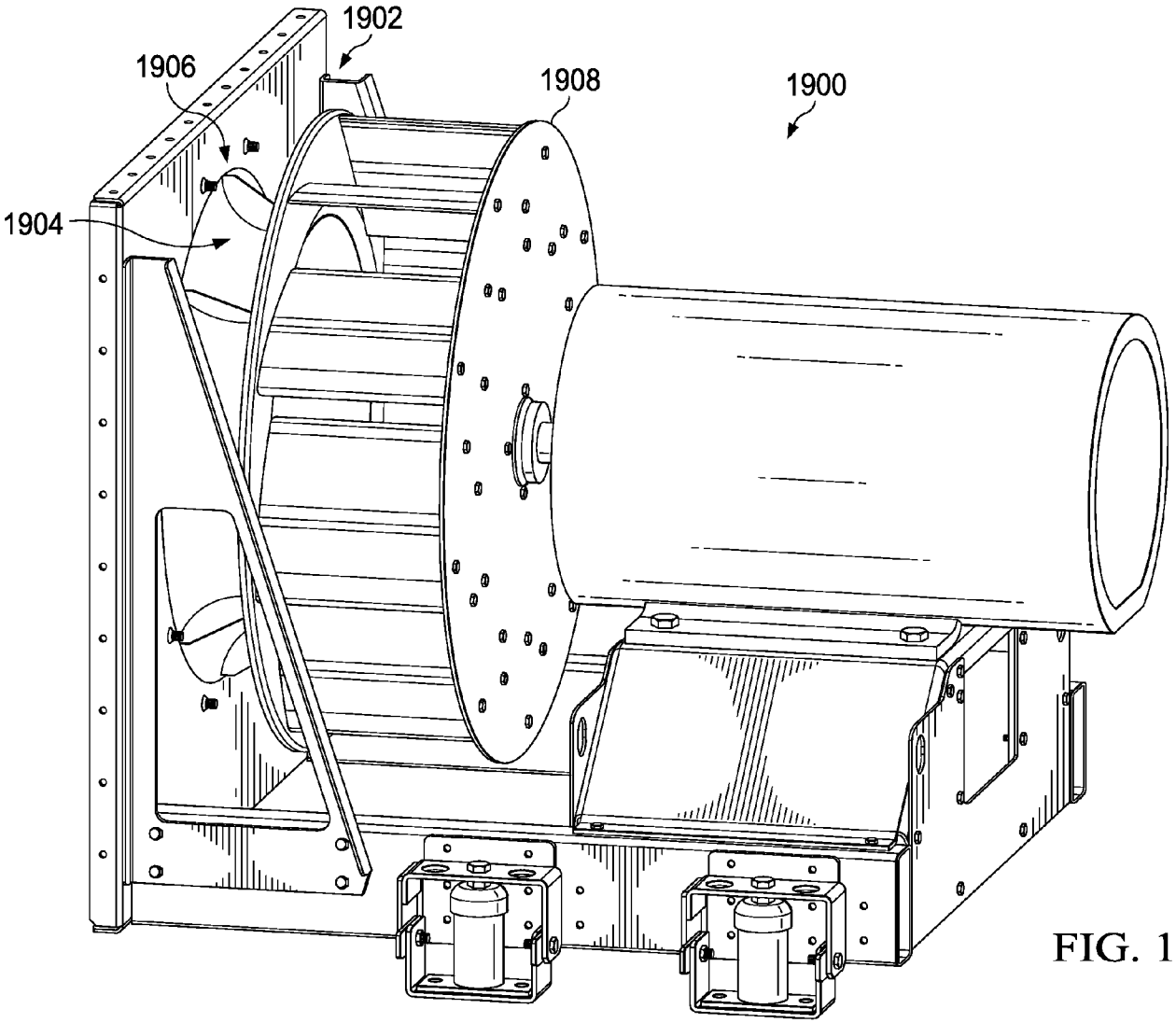
FIG. 19 is an isometric diagram of a blower assembly, in accordance with an exemplary embodiment of the present disclosure.

FIG. 19 is an isometric diagram of a blower assembly 1900, in accordance with an exemplary embodiment of the present disclosure. Blower assembly 1900 includes support structure 1902, on which inlet funnel cone 1904 is installed, by bolting base 1906 to support structure 1902. Fan 1908 abuts inlet funnel cone 1904, and receives inlet air from inlet funnel cone 1904.

Inlet funnel cone 1904 and base 1906 are coupled to an inlet panel. As an alternative embodiment, the rib features can be coupled to the inlet panel, to the gussets adjacent to the inlet panel, or to another suitable part of the fan structure, can reach down towards and get very close to the inlet funnel, or can be otherwise suitably attached. In this manner, the external rib structures described herein do not need to be coupled to the inlet funnel cone, but rather can be coupled to a suitable structure that is adjacent to the inlet funnel cone or otherwise disposed in the air flow path.

Figure 20:
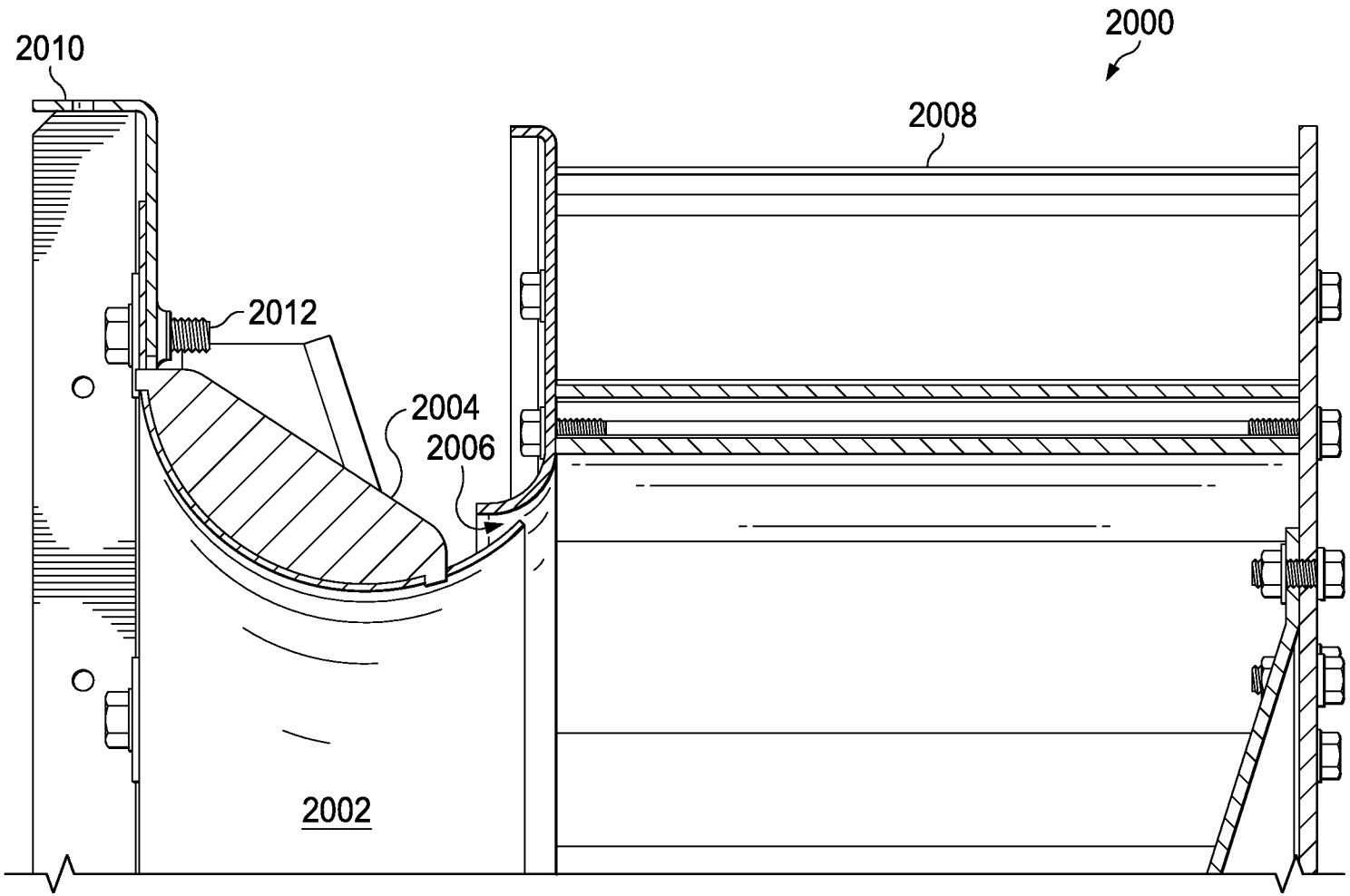
FIG. 20 is a cross-section view of a blower assembly, in accordance with an exemplary embodiment of the present disclosure.

FIG. 20 is a cross-section view of a blower assembly 2000, in accordance with an exemplary embodiment of the present disclosure. Inner surface 2002 of the inlet funnel guides inlet air into fan 2008, but inlet air is also provided through gap 2006. External rib 2004 helps to improve air flow though gap 2006, which helps to improve static efficiency of fan 2008. Inlet funnel base 2010 is coupled to a support structure with bolts 2012.

Figure 21:
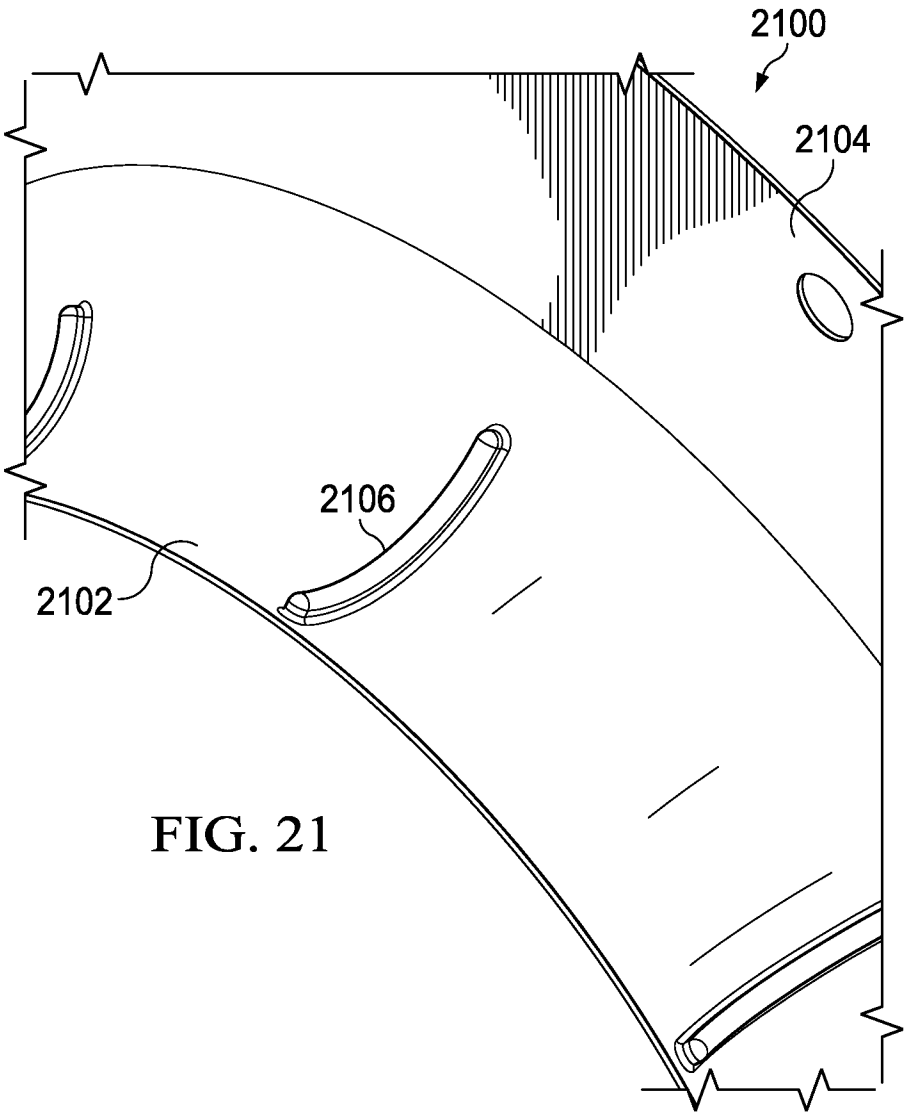
FIG. 21 is a diagram showing a fan inlet funnel having an external rib with a low profile, in accordance with an exemplary embodiment of the present disclosure.

FIG. 21 is a diagram showing a fan inlet funnel 2100 with an external rib 2106 with a low profile, in accordance with an exemplary embodiment of the present disclosure. External rib 2106 has a rounded cross section and a low profile, and can provide a suitable improvement in the static efficiency of associated fan.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A fan structure comprising:

a base;

a fan inlet funnel coupled to the base, the fan inlet funnel having an inner surface for conducting air flow into a fan inlet and an outer surface; and a plurality of external ribs coupled to the outer surface of the fan inlet funnel, wherein the base comprises a plurality of bolt holes and the air flow path includes the outer surface of the fan inlet funnel.

2. The fan structure of claim 1 wherein the base comprises a disc.

3. The fan structure of claim 1 wherein the fan inlet funnel comprises a curved portion.

4. The fan structure of claim 1 wherein the fan inlet funnel comprises a straight portion.

5. The fan structure of claim 1 wherein the fan inlet funnel comprises a curved portion and a straight portion.

6. The fan structure of claim 1 wherein the fan inlet funnel comprises a first curved portion, a straight portion having a first end coupled to the first curved portion and a second curved portion coupled to a second end of the straight portion.

7. A fan structure comprising:

a base;

a fan inlet funnel coupled to the base, the fan inlet funnel having an inner surface for conducting air flow into a fan inlet and an outer surface; and a plurality of external ribs coupled to the outer surface of the fan inlet funnel, wherein the plurality of external ribs are disposed around a periphery of the fan inlet funnel and the air flow path includes the outer surface of the fan inlet funnel.

8. The fan structure of claim 1 wherein the plurality of external ribs are disposed around a periphery of the fan inlet funnel and are each separated from adjacent external ribs by approximately a same distance.

9. A fan structure comprising:

a base;

a fan inlet funnel coupled to the base, the fan inlet funnel having an inner surface for conducting air flow into a fan inlet and an outer surface; and a plurality of external ribs coupled to the outer surface of the fan inlet funnel, wherein the plurality of external ribs are coupled to the fan inlet funnel by one or more tabs and the air flow path includes the outer surface of the fan inlet funnel.

10. The fan structure of claim 1 wherein the plurality of external ribs extend from the base onto the fan inlet funnel.

11. The fan structure of claim 1 wherein the plurality of external ribs follow a curvature of the fan inlet funnel.

12. The fan structure of claim 1 wherein the plurality of external ribs curve radially around the fan inlet funnel in a clockwise or counter-clockwise direction.

13. A fan structure comprising:

a base;

a fan inlet funnel coupled to the base, the fan inlet funnel having an inner surface for conducting air flow into a fan inlet and an outer surface; and a plurality of external ribs coupled to the outer surface of the fan inlet funnel, wherein the plurality of external ribs extend for less than an entire length of the fan inlet funnel and the air flow path includes the outer surface of the fan inlet funnel.

14. The fan structure of claim 1 wherein the base, the fan inlet funnel and the plurality of external ribs are formed from a single material.

15. The fan structure of claim 1 wherein the base, the fan inlet funnel and the plurality of external ribs are formed from a single material by a molding process.

16. The fan structure of claim 1 wherein the base, the fan inlet funnel and the plurality of external ribs are formed from two or more different materials.

17. The fan structure of claim 1 wherein the base has an inner diameter and an outer diameter, and the fan inlet funnel has a lower diameter, a minimum inner diameter and an upper outlet diameter.

18. The fan structure of claim 1 wherein the base has an inner diameter D4 and an outer diameter D1, and the fan inlet funnel has a lower diameter D4, a minimum inner diameter D2 and an upper outlet diameter D3.

19. The fan structure of claim 1 wherein the base has an inner diameter D4 and an outer diameter D1, and the fan inlet funnel has a lower diameter D4, a minimum inner diameter D2 and an upper outlet diameter D3, and where D1>D4>D3>D2.

* * * * *